US009964906B2

(12) United States Patent
Sakai

(10) Patent No.: US 9,964,906 B2
(45) Date of Patent: May 8, 2018

(54) FIXING DEVICE AND IMAGE FORMING APPARATUS INCLUDING THE SAME

(71) Applicant: KYOCERA Document Solutions Inc., Osaka (JP)

(72) Inventor: Yuhiro Sakai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/423,933

(22) Filed: Feb. 3, 2017

(65) Prior Publication Data

US 2017/0269523 A1 Sep. 21, 2017

(30) Foreign Application Priority Data

Mar. 16, 2016 (JP) ..... 2016-052187

(51) Int. Cl.
*G03G 15/20* (2006.01)

(52) U.S. Cl.
CPC ..... *G03G 15/2089* (2013.01)

(58) Field of Classification Search
CPC ..... G03G 15/2089
See application file for complete search history.

(56) References Cited

U.S. PATENT DOCUMENTS 5,045,887 A * 9/1991 Nakamura ..... G03G 15/2035 399/122
2011/0069984 A1* 3/2011 Watanabe ..... G03G 15/2028 399/67
2013/0064584 A1* 3/2013 Yonemoto ..... G03G 15/2067 399/328

FOREIGN PATENT DOCUMENTS

JP 2005-043823 A 2/2005

* cited by examiner

*Primary Examiner* — Clayton E LaBalle
*Assistant Examiner* — Jas Sanghera
(74) *Attorney, Agent, or Firm* — Studebaker & Brackett PC

(57) ABSTRACT

A fixing device includes a pressuring member, a fixing frame, a pressuring frame, a pressure changing part, a rotation detecting part and a rotation transmitting part. The pressuring member forms a fixing nip with a fixing member. The fixing frame supports the fixing member. The pressuring frame supports the pressuring member. The pressure changing part changes fixing nip pressure. The rotation transmitting part transmits rotation of the pressuring member to the rotation detecting part. The fixing frame is turnably supported around a fulcrum part provided on the pressuring frame. The pressure changing part turns the fixing frame around the fulcrum part. The rotation transmitting part has a first rotating body and a second rotating body. The first rotating body is provided on a rotation shaft of the pressuring member. The second rotating body is engaged with the first rotating body and rotatably supported around the fulcrum part.

10 Claims, 7 Drawing Sheets

FIXING DEVICE AND IMAGE FORMING APPARATUS INCLUDING THE SAME

INCORPORATION BY REFERENCE

This application is based on and claims the benefit of priority from Japanese Patent Application No. 2016-052187 filed on Mar. 16, 2016, which is incorporated by reference in its entirety.

BACKGROUND

The present disclosure relates to a fixing device which fixes a toner image on a sheet and an image forming apparatus including the fixing device.

An electrophotographic type image forming apparatus is provided with a fixing device including a pressuring roller which comes into pressure contact with a fixing roller which is to be heated. The fixing device includes a pressure changing part which changes pressure at a fixing nip formed between the pressuring roller and the fixing roller. The pressure changing part changes the pressure at the fixing nip by turning a fixing roller supporting frame around an axis.

The fixing device further includes a rotation detecting part which detects rotation of the pressuring roller via a plurality of gears. The rotation detecting part detects rotation of the fixing roller by detecting the rotation of the pressuring roller. Thereby, the fixing roller can be prevented from being heated locally in a state where the rotation of the fixing roller is stopped.

A driving force transmitting device which transmits driving force to the fixing roller has been known although not a mechanism which transmits rotation force from the pressuring roller to the rotation detecting device. An example of the driving force transmitting device has a driven gear fixed to the fixing roller and a fixing roller driving gear which is rotatably supported by a side frame to which a fixing unit (the fixing device) is fixedly attached. In the driving force transmitting device, a rotating shaft (a pin) of the fixing roller driving gear is engaged with an engagement part formed in the fixing unit. By engaging the pin with the engagement part, the fixing roller driving gear and the driven gear are engaged with each other at a predetermined position.

SUMMARY

In accordance with an aspect of the present disclosure, a fixing device includes a fixing member, a pressuring member, a fixing frame, a pressuring frame, a pressure changing part, a rotation detecting part and a rotation transmitting part. The fixing member is heated by a heat source. The pressuring member forms a fixing nip with the fixing member. The fixing frame rotatably supports the fixing member. The pressuring frame rotatably supports the pressuring member. The pressure changing part changes pressure at the fixing nip. The rotation detecting part detect rotation of the pressuring member. The rotation transmitting part transmits the rotation of the pressuring member to the rotation detecting part. The fixing frame is supported so as to be turnable around a fulcrum part provided on the pressuring frame. The pressure changing part turns the fixing frame around the fulcrum part to change the pressure at the fixing nip. The rotation transmitting part has a first rotating body and a second rotating body. The first rotating body is provided on a rotation shaft of the pressuring member. The second rotating body is engaged with the first rotating body and supported so as to be rotatable around the fulcrum part.

In accordance with an aspect of the present disclosure, an image forming apparatus includes an image forming part and a fixing device. The image forming part transfers a toner image on a sheet. The fixing device described above fixes the toner image on the sheet.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, a preferable embodiment of the present disclosure will be described. The following description is based on directions shown in each figure.

Figure 1:
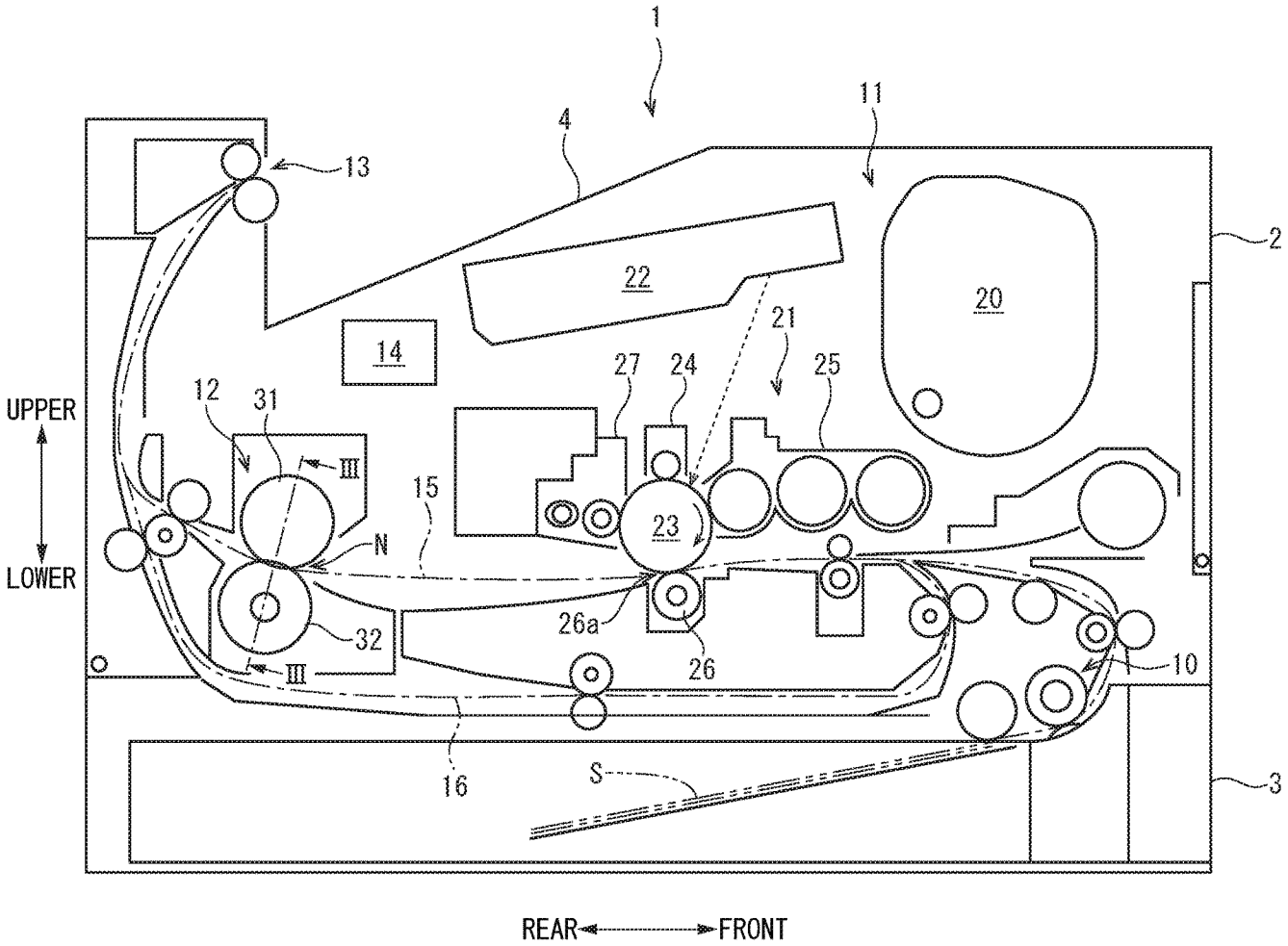
FIG. 1 is a sectional view schematically showing an inner structure of a printer according to an embodiment of the present disclosure.

With reference to FIG. 1, a printer 1 that is an image forming apparatus will be described. FIG. 1 is a sectional view schematically showing an internal structure of the printer 1.

The printer 1 includes an apparatus main body 2, a sheet feeding cassette 3 and an ejection tray 4. The sheet feeding cassette 3 is provided in a lower portion of the apparatus main body 2 so as to be detachably inserted in the front and rear direction. In the sheet feeding cassette 3, the sheets S (a bundle of sheets) are stored. The ejection tray 4 is formed on an upper face of the apparatus main body 2.

The printer 1 further includes a sheet feeding part 10, an image forming part 11, a fixing device 12, an ejecting part 13 and a control device 14. The sheet feeding part 10 is disposed on an upstream side end portion of a conveying path 15 extending from the sheet feeding cassette 3 to the ejection tray 4. The image forming part 11 and the fixing device 12 are disposed on a middle portion of the conveying path 15. The ejecting part 13 is disposed on a downstream side end portion of the conveying path 15. The control device 14 totally controls the printer 1. Below the conveying path 15, an inversion path 16 along which the sheet S is conveyed at a duplex printing is formed.

The sheet feeding part 10 feeds the sheet S stored in the sheet feeding cassette 3 toward the conveying path 15 one by one. The image forming part 11 transfers a toner image on the sheet S. The image forming part 11 has a toner container 20, a drum unit 21 and an optical scanning device 22.

The toner container 20 contains a toner (a developer) of black color, for example. The drum unit 21 has a photosensitive drum 23, a charging device 24, a developing device 25, a transferring roller 26 and a cleaning device 27. The charging device 24, the developing device 25, the transferring roller 26 and the cleaning device 27 are disposed around the photosensitive drum 23 in the order of transferring process. The transferring roller 26 comes into pressure contact with the photosensitive drum 23 from the lower side to form a transferring nip 26*a*. The fixing device 12 has a pressuring roller 32 which forms a fixing nip N with a fixing belt 31, as described later in detail.

Here, an operation of the printer 1 will be described. The control device 14 executes the following image forming operation based on an input image date.

The charging device 24 charges a surface of the photosensitive drum 23. The optical scanning device 22 exposes the photosensitive drum 23 based on the image data (refer to a dashed arrow in FIG. 1). The developing device 25 develops a latent image on the photosensitive drum 23 into a toner image. On the other hand, the sheet S is conveyed from the sheet feeding cassette 3 to the conveying path 15. The toner image is transferred on the sheet S passing through the transferring nip 26*a*. The fixing device 12 presses and heats the sheet S passing through the fixing nip N to fix the toner image on the sheet S. After the fixing processing, the sheet S is ejected by the ejecting part 13 on the ejection tray 4.

Figure 2:
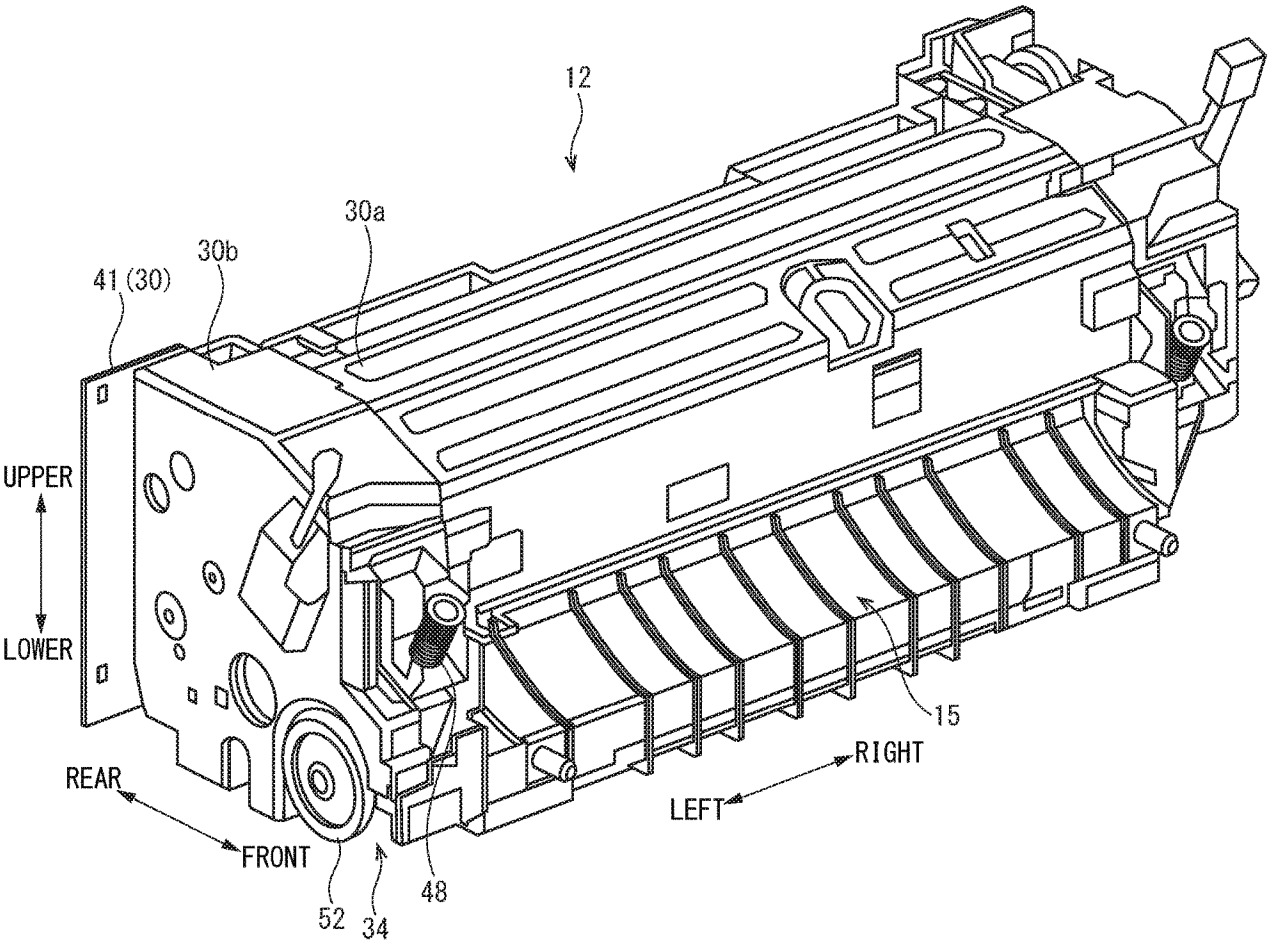
FIG. 2 is a perspective view showing a fixing device according to an embodiment of the present disclosure.
Figure 3:
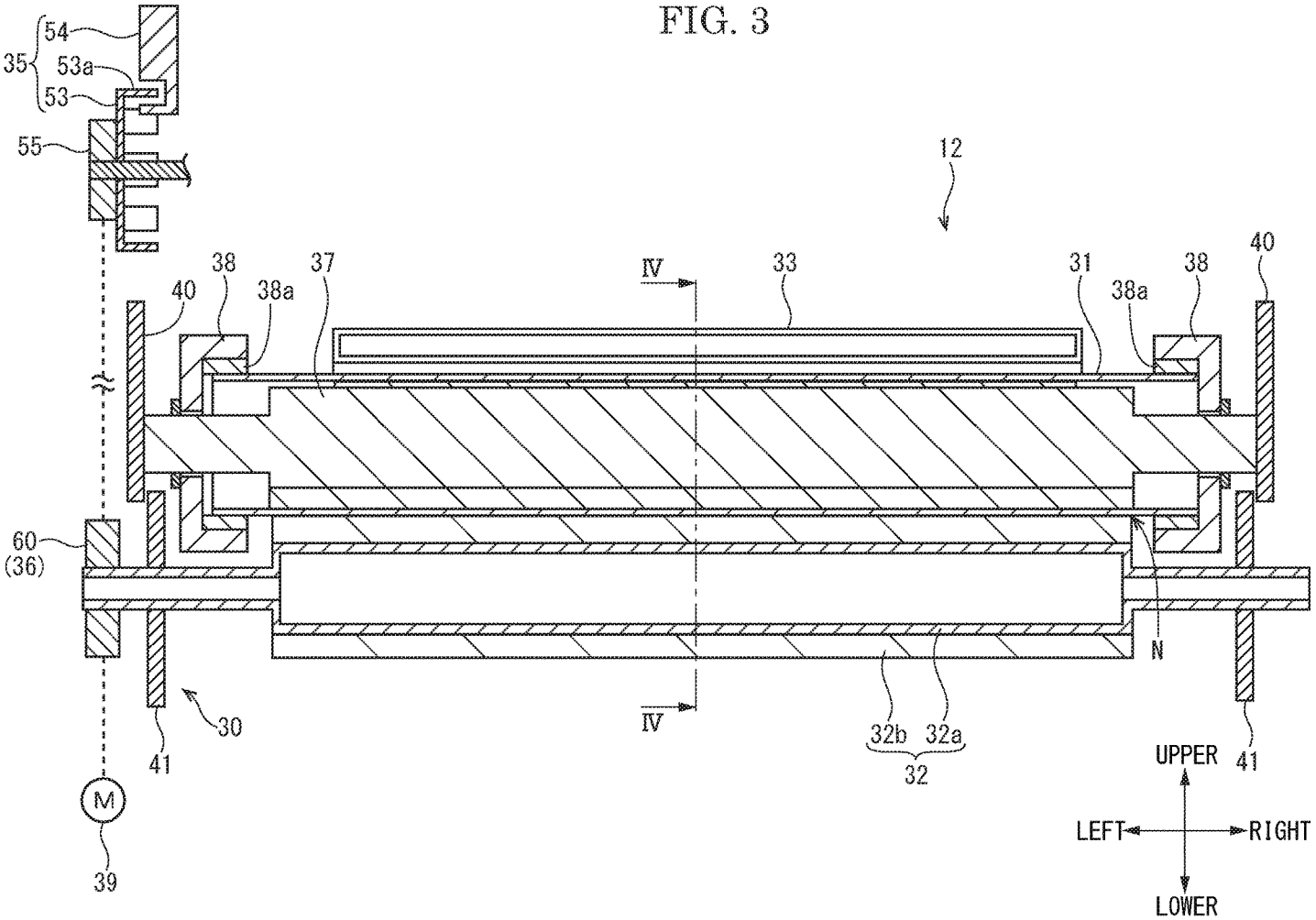
FIG. 3 is a III-III sectional view of FIG. 1.
Figure 4:
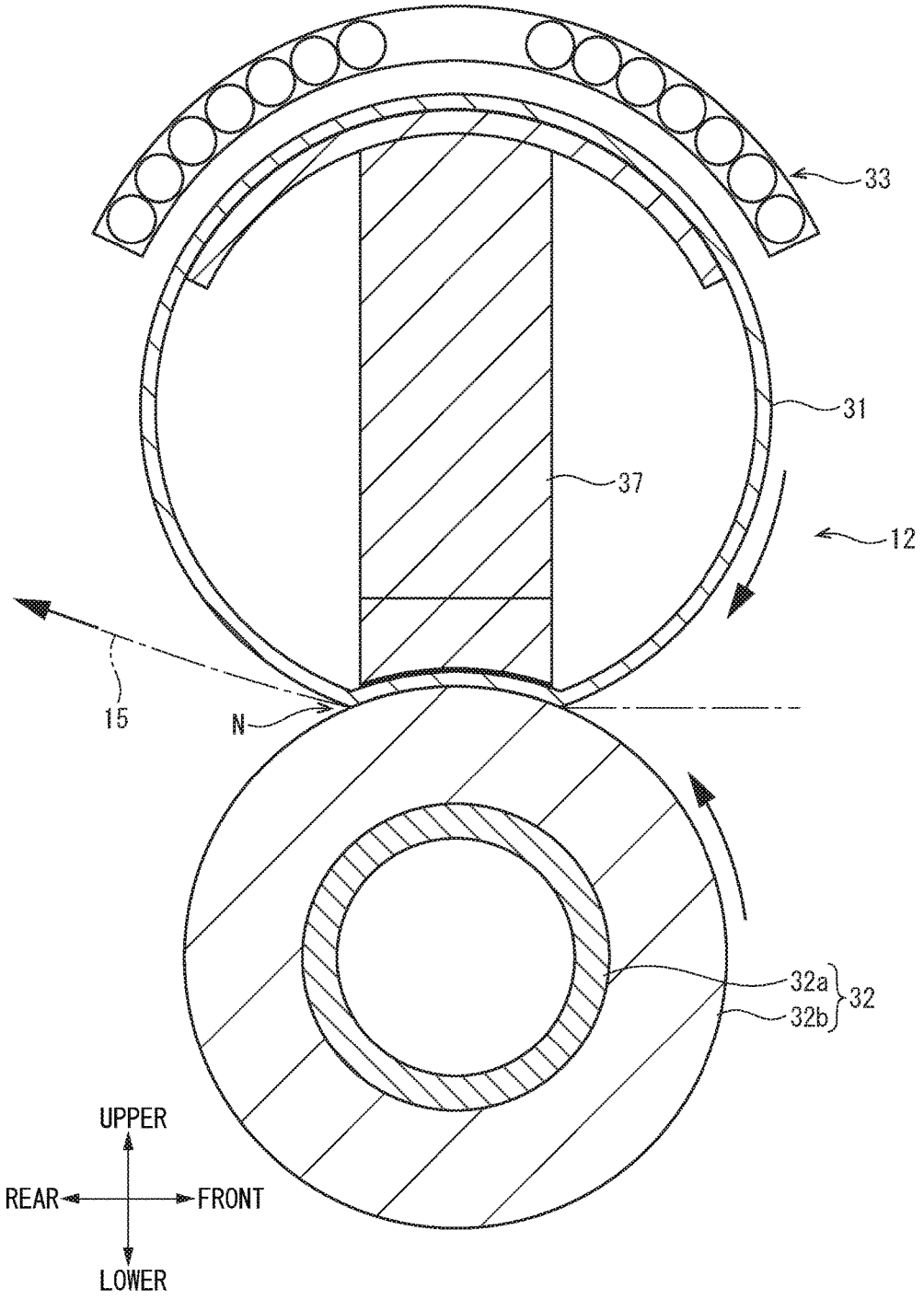
FIG. 4 is a IV-IV sectional view of FIG. 3.
Figure 5:
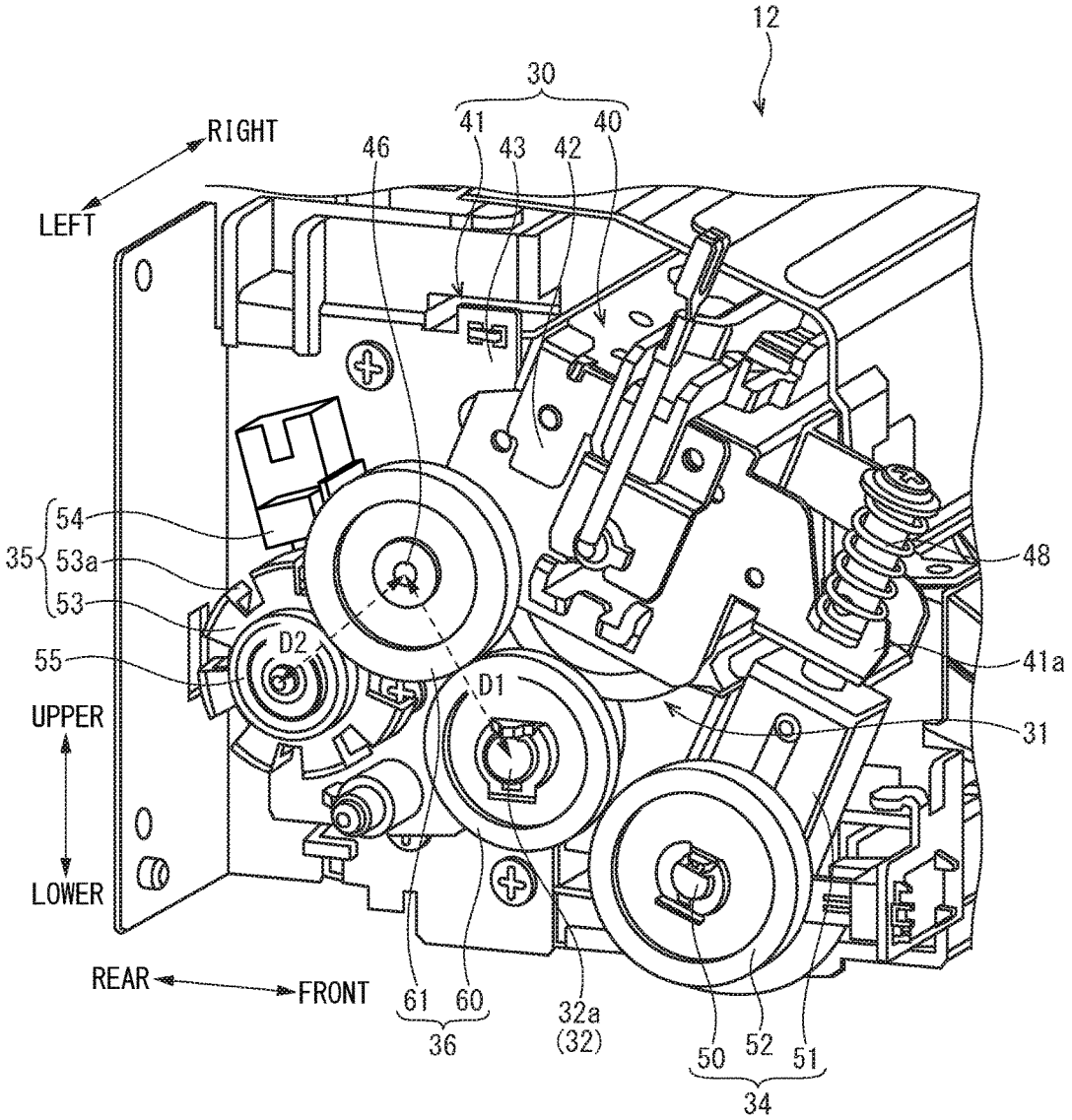
FIG. 5 is a perspective view showing a left side portion of the fixing device according to the embodiment of the present disclosure.
Figure 6:
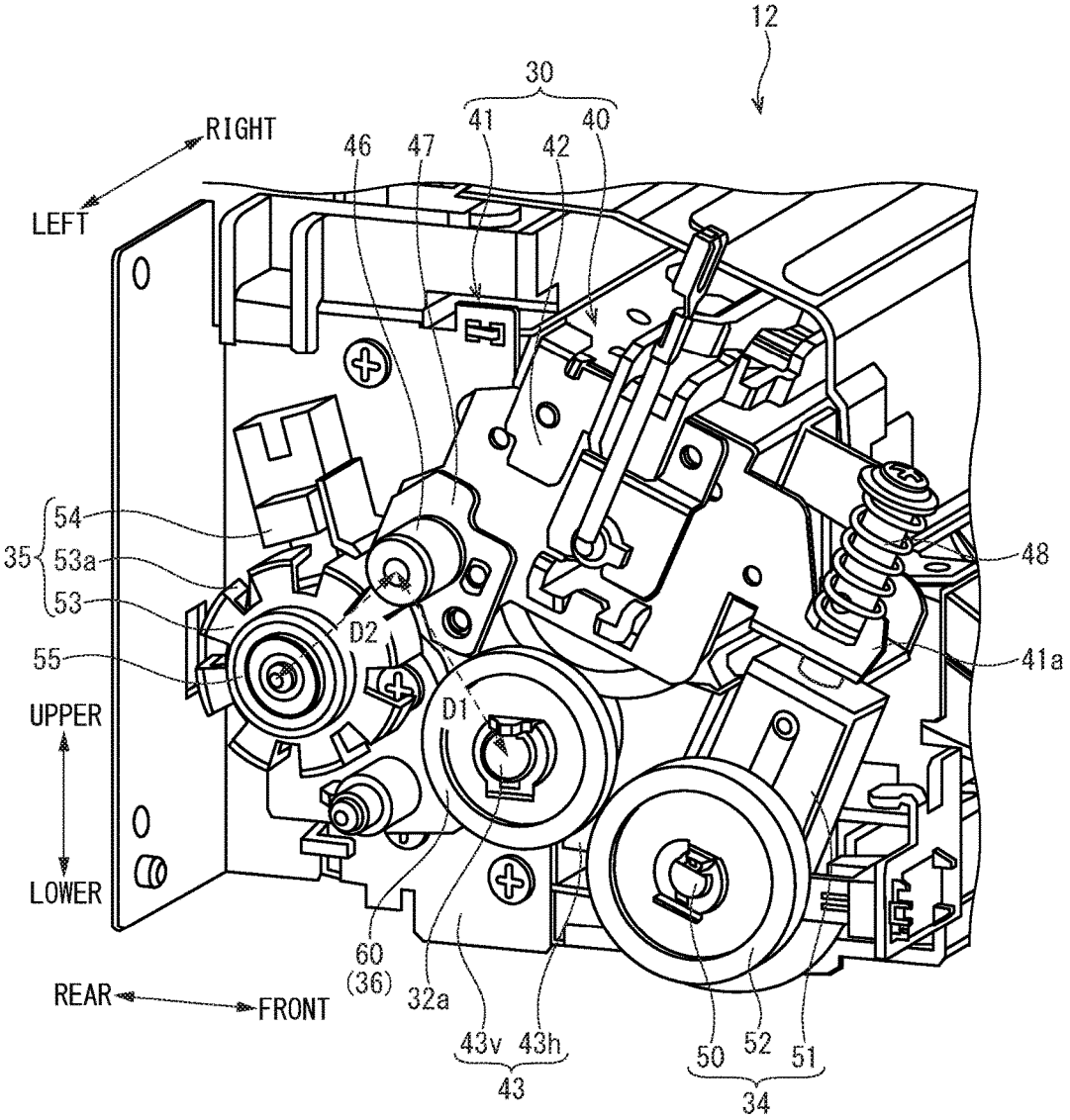
FIG. 6 is a perspective view showing a vicinity around a left fulcrum pin of the fixing device according to the embodiment of the present disclosure.
Figure 7:
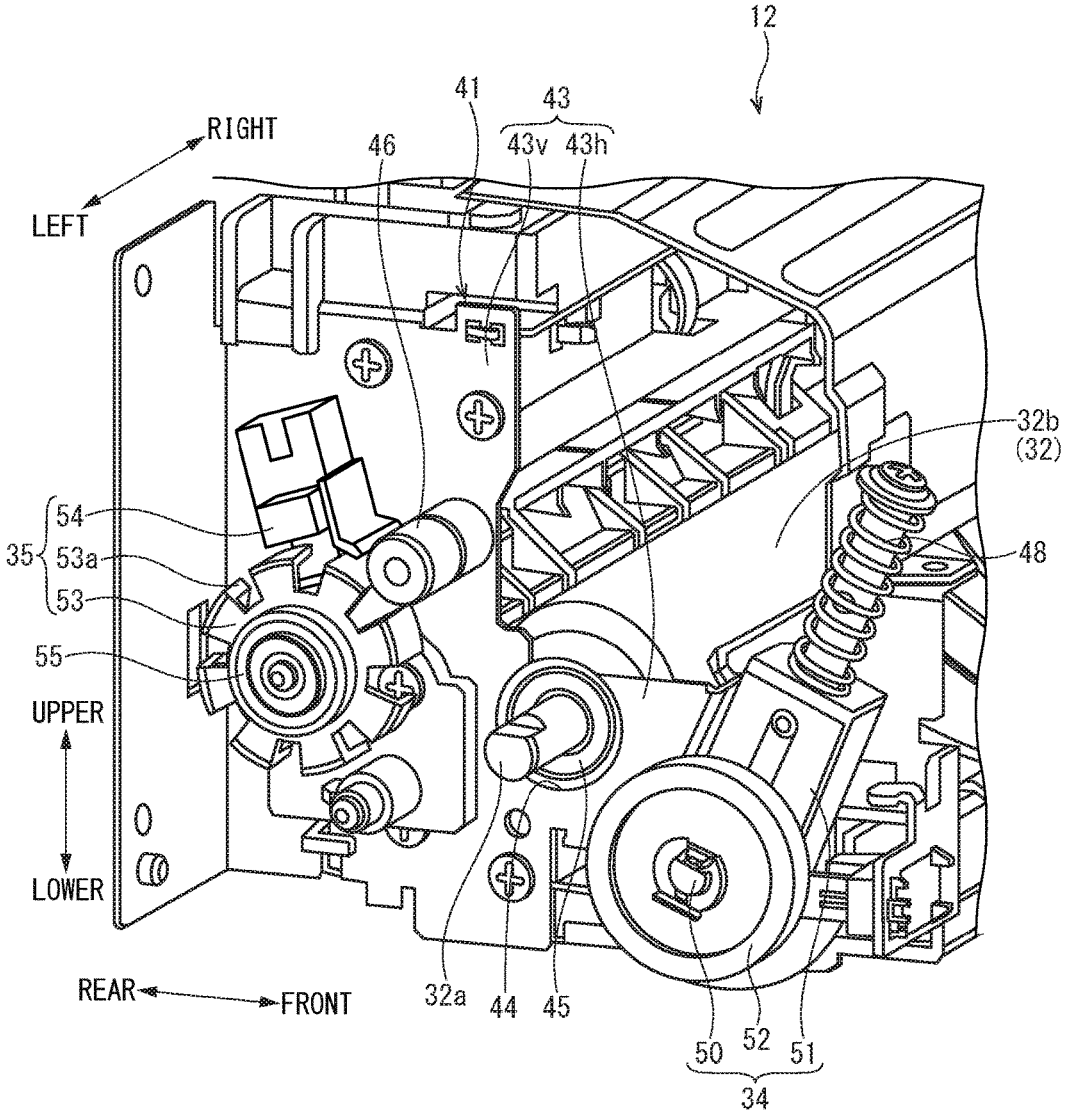
FIG. 7 is a perspective view showing a left pressuring frame and the others of the fixing device according to the embodiment of the present disclosure.

Next, with reference to FIGS. 2 to 7, the fixing device 12 will be described. FIG. 2 is a perspective view showing the fixing device 12. FIG. 3 is a III-III sectional view of FIG. 1. FIG. 4 is a IV-IV sectional view of FIG. 3. FIG. 5 is a perspective view showing a left side portion of the fixing device 12. FIG. 6 is a perspective view showing a vicinity around a left fulcrum pin 46 of the fixing device 12. FIG. 7 is a perspective view showing a left pressuring frame 41 and the others of the fixing device 12.

As shown in FIGS. 2 and 3, the fixing device 12 includes a device frame 30, a fixing belt 31, a pressuring roller 32, an induction heating (IH) heater 33, a pressure changing part 34, a rotation detecting part 35 and a rotation transmitting part 36. The fixing device 12 employs a so-called sliding belt type.

As shown in FIG. 2, the device frame 30 has a case 30*a* and a cover 30*b*, and is formed into a substantially rectangular parallelepiped shape elongated in the left and right direction. On the case 30*a*, a part of the conveying path 15 which introduces the sheet S to the fixing nip N is formed. The details of the device frame 30 will be described later.

As shown in FIGS. 3 and 4, the fixing belt 31 that is a fixing member has flexibility, and is formed into an endless shape. The fixing belt 31 is formed into a cylindrical shape elongated in the left and right direction (a direction of a rotation axis). The fixing belt 31 is supported by the device frame 30 so as to be capable of rotating (circulating). The fixing belt 31 is formed by laminating a substrate layer, an elastic layer and a releasing layer in the order from the inner side (they are not shown). The substrate layer is made of polyimide resin mixed with metal powder, for example. The elastic layer is made of silicon rubber, for example. The releasing layer is made of fluororesin, for example.

In an inner hollow space of the fixing belt 31, a pressing member 37 is non-rotatably disposed. The pressing member 37 presses the fixing belt 31 on the pressuring roller 32. On both ends of the fixing belt 31 in the left and right direction (the direction of the rotation axis), a pair of left and right caps 38 is attached. Between an inner circumferential face of each cap 38 and an outer circumferential face of the fixing belt 31, an annular elastic member 38*a* is interposed. Both left and right end portions of the above described pressing member 37 penetrate through the pair of left and right caps 38.

The pressuring roller 32 that is a pressuring member is formed into a cylindrical shape elongated in the left and right direction. The pressuring roller 32 is supported by the device frame 30 so as to be rotatable around an axis. The pressuring roller 32 comes into pressure contact with the fixing belt 31 from the lower side of the fixing belt 31. Between the fixing belt 31 and the pressuring roller 32, the fixing nip N is formed. The pressuring roller 32 is formed by laminating an elastic layer 32*b* and the others on an outer circumferential face of a cylindrical core material 32*a*. The core material 32*a* that is a rotation shaft is made of metal, such as stainless steel and aluminum, for example. The elastic layer 32*b* is made of silicon rubber or silicon sponge, for example. On an outer circumferential face of the elastic layer 32*a*, a releasing layer (fluororesin, not shown) is laminated.

To a left end portion of the core material 32*a*, a first gear 60 connected to a fixing driving motor 39 is fixedly attached (refer to FIG. 3). The fixing driving motor 39 drives the pressuring roller 32 via the first gear 60 to rotate it around the rotation shaft.

The IH heater 33 that is a heat source is disposed on an upper side (an opposing side to the fixing nip N) of the fixing belt 31. The IH heater 33 generates magnetic field to heat the fixing belt 31.

As shown in FIGS. 5 to 7, the device frame 30 has a fixing frame 40 and a pressuring frame 41. The fixing frame 40 and the pressuring frame 41 are formed by sheet metal working, for instance. Both left and right ends of the fixing frame 40 and the pressuring frame 41 are covered with the covers 30*b* (refer to FIG. 2).

The fixing fame 40 supports the fixing belt 31 via the pressing member 37 so as to be rotatable (refer to FIG. 3). In detail, both left and right ends of the pressing member 37 are fixedly attached to a pair of left and right fixing side plates 42 of the fixing frame 40. The fixing belt 31 is configured to be capable of circulating around the pressing member 37.

As shown in FIG. 7, the pressuring frame 41 supports the pressuring roller 32 so as to be rotatable. A pair of left and right pressuring side plates 43 of the pressuring fame 41 each are formed into a substantially L shape in the side view. Each pressuring sideplate 43 has a vertical plate 43*v* elongated in the vertical direction and a horizontal plate 43*h* extending forward from a lower portion of the vertical plate 43*v*. Each horizontal plate 43*h* has a positioning hole 44 (a positioning part) to which a bearing 45 is fixedly attached. Each positioning hole 44 is recessed downward from an upper edge of the horizontal plate 43*h*. The pair of left and right positioning holes 44 support the core material 32*a* (the rotating shaft) of the pressuring roller 32 via the bearings 45.

On the vertical plate 43*v* of each pressuring side plate 43, a fulcrum pin 46 that is a fulcrum part is provided. The pair of left and right fulcrum pins 46 is protruded outward (in a direction separating from each other) from the pair of left and right vertical plates 43*v*.

As shown in FIG. 6, each fulcrum pin 46 penetrates through a rear lower portion of each fixing side plate 42 of the fixing frame 40. Thereby, the fixing frame 40 is rotatably (turnably) supported by the pair of left and right fulcrum pins 46. Around each fulcrumpin 46, a restriction plate 47 is fitted. Each fulcrum pin 46 penetrates through a loose hole (not shown) formed in the restriction plate 47. The pair of left and right restriction plates 47 is fixedly attached (fastened with screws) to the fixing side plates 42 of the fixing frame 40. The pair of left and right restriction plates 47 restricts the fixing frame 40 supported by each fulcrum pin 46 from being moved in the left and right direction (the direction of the rotation axis). Thereby, the fixing frame 40 can be rotated around each fulcrum pin 46 without displacing in the direction of the rotation axis. Accordingly, positioning precision of the fixing belt 31 is improved so that the fixing nip N can be suitably formed.

As shown in FIGS. 5 and 6, each fixing side plate 42 of the fixing frame 40 has an arm part 41*a* extending forward. Between each arm part 41*a* and the apparatus main body 2, a coil spring 48 is interposed. The pair of left and right coil springs 48 biases the fixing frame 40 toward a side of the pressuring roller 32. The fixing belt 31 is biased by the coil springs 48 to be moved to a contact position where the fixing belt 31 comes into pressure contact with the pressuring roller 32. In this state, the fixing nip N where is set at a predetermined pressure is formed.

The pressure changing part 34 is configured to adjust biasing force of the coil springs 48 so as to change the pressure at the fixing nip N. The pressure changing part 34 has a pair of left and right eccentric cams (not shown), a rotation connecting shaft 50 and a pair of left and right activating parts 51. FIGS. 5 to 7 show the left side portion of the pressure changing part 34.

The pair of left and right eccentric cams is fixed to the rotation connecting shaft 50, and rotates around the rotation connecting shaft 50. Each of the eccentric cam is formed to have a change in distance from a circumferential cam face to a rotation center. To a left end portion of the rotation connecting shaft 50, a pressure changing gear 52 connected to a motor (not shown) is fixedly attached. On driving the motor, each eccentric cam (the rotation connecting shaft 50) is rotated. The motor is electrically connected to the control device 14 to be controlled to be driven.

Each activating part 51 is configured to be relatively slid on the circumferential cam face of each eccentric cam. Each activating part 51 is moved upward and downward as each eccentric cam is rotated. When each activating part 51 is moved upward, each arm part 41*a* of the fixing frame 40 is moved upward against biasing force of the coil spring 48. Thereby, the fixing belt 31 is kept at a state where the fixing belt 31 is moved to a release position where a pressure contact state against the pressuring roller 32 is set to be capable of releasing. On the other hand, when each activating part 51 is moved downward, each arm part 41*a* is biased by each coil spring 48 to be moved downward. Thereby, the fixing belt 31 is kept at another state where the fixing belt 31 is moved to a contact position where the fixing belt 31 is set to be capable of coming into pressure contact with the pressuring roller 32. That is, the fixing belt 31 (the fixing frame 40) is configured to be turnable between the contact position and the release position. The pressure changing part 34 changes the pressure at the fixing nip N by rotating (turning) the fixing frame 40 around the fulcrum pins 46. The control device 14 moves the fixing belt 4 to the release position when the fixing processing (the image forming processing) is stopped.

As shown in FIGS. 5 to 7, the rotation detecting part 35 is provided on the left pressuring side plate 43 of the pressuring frame 41. The rotation detecting part 35 has a pulse plate 53 and a rotation detecting sensor 54.

The pulse plate 53 is rotatably supported by the vertical plate 43*v* of the left pressuring side plate 43. The pulse plate 53 is positioned on a lower rear side of the fulcrum pin 46. The pulse plate 53 has a plurality of light-shielding pieces 53*a* extending in a direction parallel to a rotation axis of the pule plate 53 and arranged in a circumferential direction at equal intervals. The pulse plate 53 is formed into a substantially cap shape with each light-shielding piece 53*a* extending rightward (refer to FIG. 3). On a left face of the pulse plate 53, a transmitting gear 55 is fixedly attached. The transmitting gear 55 is positioned on the same rotation axis as the rotation axis of the pulse plate 53.

The rotation detecting sensor 54 is a photo-interrupter having a light emitting part and a light receiving part (they are not shown) which oppose to each other on both sides of the pulse plate 53 (refer to FIG. 3). The rotation detecting sensor 54 is configured to detect rotation of the pulse plate 53. The rotation detecting sensor 54 transmits light receiving information changing depending on the rotation of the pulse plate 53 to the control device 14.

As shown in FIG. 5, the rotation transmitting part 36 is provided on the left pressuring side plate 43 of the pressuring frame 41. The rotation transmitting part 36 has the above described first gear 60 and a second gear 61. The first gear 60 and the second gear 61 are so-called spur gears.

As described above, the first gear 60 that is a first rotating body is provided on the core material 32*a* (the rotation shaft) of the pressuring roller 32. The second gear 61 that is a second rotating body is rotatably supported by the left fulcrum pin 46. The second gear 61 is arranged so as to be meshed (engaged) with the transmitting gear 55 and the first gear 60. That is, the pulse plate 53 is engaged with the second gear 61 via the transmitting gear 55. As described above, the rotation transmitting part 36 transmits the rotation of the pressuring roller 32 to the rotation detecting part 35 (the pulse plate 53). Thereby, the rotation detecting part 35 can detect the rotation of the pressuring roller 32.

According to the fixing device 12 as described above, each fulcrum pin 46 supporting the second gear 61 is provided on the pressuring frame 41 supporting the pressuring roller (the first gear 60). That is, the first gear 60 and the second gear 61 are provided on the same member (the pressuring frame 41). Thereby, a distance D1 between centers of the both gears 60 and 61 can be set with high precision (refer to FIGS. 5 and 6). Accordingly, the rotation force can be effectively transmitted from the pressuring roller 32 to the rotation detecting part 35.

The fulcrum pin 46 is used as a member supporting the fixing frame 40 in addition to the second gear 61. The fixing frame 40 and the second gear 61 are rotated around the same fulcrum (each fulcrum pin 46). Thereby, a manufacturing cost can be reduced compared with a case where a rotation fulcrum of the fixing frame 40 and a rotation fulcrum of the second gear 61 are separately formed.

In addition, according to the fixing device 12 described above, the pressuring roller 32 (the both end portions of the core material 32*a*) is supported by each positioning hole 44 and thus can be positioned to the pressuring frame 41 with high precision. Thereby, positioning precision of the first gear 60 and the second gear 61 can be improved.

In addition, according to the fixing device 12 described above, the pulse plate 53 is also provided on the same member (the pressuring frame 41) in addition to the first gear 60 and the second gear 61. Thereby, a distance D2 between centers of the second gear 61 and the pulse plate 53 can be set with high precision (refer to FIGS. 5 and 6) so that the pulse plate 53 can be smoothly rotated.

The rotation transmitting part 36 of the fixing device 12 of the embodiment has two of the gears 60 and 61; the present disclosure is not limited to the embodiment. For instance, the rotation transmitting part 36 may have three or more gears. In this case, each gear may be rotatably supported to the pressuring frame 41 (either one of the left and right pressuring side plates 43).

The rotation transmitting part 36 of the fixing device 12 of the embodiment has the gears 60 and 61; the present disclosure is not limited to the embodiment. For instance, the rotation transmitting part may have a plurality of gears adjacently and tightly arranged. Alternatively, the rotation transmitting part may have a plurality of pulleys engaged via a belt.

In the embodiment, the control device 14 totally controls the printer 1; a dedicated control device which controls the fixing device 12 may be provided. In the embodiment, the IH heater 33 is employed as the heat source; the present disclosure is not limited to the embodiment. For instance, a halogen heater may be provided in the hollow inner space of the fixing belt 31. Furthermore, in the embodiment, the fixing device 12 employs the sliding belt type; the present disclosure is not limited to the embodiment. For instance, a fixing roller having an elastic layer may be employed other than the fixing belt 31.

Although each embodiment was described in a case where configurations of the disclosure are applied to the monochromatic printer 1 as an example, the configurations of the disclosure may be applied to a color printer, a copying machine, a facsimile or a multifunctional peripheral, other than the monochromatic printer 1.

As another embodiment of the fixing device 12 of the embodiment, the fixing belt 31 and the pressuring roller 32 may be switched. In this case, the same effect as that of the present embodiment can be obtained. In another embodiment, the fixing belt 31 and the pressuring roller 32 maybe switched on the figures of the present embodiment.

While the above embodiments has been described with reference to one embodiment of the fixing device and the image forming apparatus including the fixing device according to the present disclosure. A technical scope of the disclosure is not to be restricted by the above embodiments. The components in the above embodiments may be suitably replaced with other components, or variously combined with the other components. The claims are not restricted by the description of the embodiment of the disclosure as mentioned above.

The invention claimed is:

1. A fixing device comprising:

a fixing member heated by a heat source;

a pressuring member which forms a fixing nip with the fixing member;

a fixing frame which rotatably supports the fixing member;

a pressuring frame which rotatably supports the pressuring member, a pressure changing part which changes pressure at the fixing nip;

a rotation detecting part which detects rotation of the pressuring member; and a rotation transmitting part which transmits the rotation of the pressuring member to the rotation detecting part, wherein the fixing frame is supported so as to be turnable around a fulcrum part provided on the pressuring frame, the pressure changing part turns the fixing frame around the fulcrum part to change the pressure at the fixing nip, and the rotation transmitting part includes:

a first rotating body provided on a rotation shaft of the pressuring member; and a second rotating body engaged with the first rotating body and supported so as to be rotatable around the fulcrum part, the fulcrum part is used as a member supporting the fixing frame in addition to the second rotating body.

2. The fixing device according to claim 1, wherein the pressuring frame has a positioning part which supports the rotating shaft of the pressuring member.

3. The fixing device according to claim 2, further comprising a restriction plate which prevents the fixing frame supported by the fulcrum part being moved in a direction of a turning axis of the fixing frame.

4. The fixing device according to claim 2, wherein the rotation detecting part includes:

a pulse plate engaged with the second rotating body of the rotation detecting part and rotatably supported to the pressuring frame; and a sensor which detects rotation of the pulse plate.

5. The fixing device according to claim 1, further comprising a restriction plate which prevents the fixing frame supported by the fulcrum part being moved in a direction of a turning axis of the fixing frame.

6. The fixing device according to claim 5, wherein the rotation detecting part includes:

a pulse plate engaged with the second rotating body of the rotation detecting part and rotatably supported to the pressuring frame; and a sensor which detects rotation of the pulse plate.

7. The fixing device according to claim 1, wherein the rotation detecting part includes:

a pulse plate engaged with the second rotating body of the rotation detecting part and rotatably supported by the pressuring frame; and a sensor which detects rotation of the pulse plate.

8. An image forming apparatus comprising:

an image forming part which transfers a toner image on a sheet; and a fixing device according to claim 1, which fixes the toner image on the sheet.

9. A fixing device comprising:

a fixing member heated by a heat source;

a pressuring member which forms a fixing nip with the fixing member;

a fixing frame which rotatably supports the fixing member;

a pressuring frame which rotatably supports the pressuring member, a pressure changing part which changes pressure at the fixing nip;

a rotation detecting part which detects rotation of the fixing member; and a rotation transmitting part which transmits the rotation of the fixing member to the rotation detecting part, wherein the pressuring frame is rotatably supported by a fulcrum part provided on the fixing frame, the pressure changing part turns the pressuring frame around the fulcrum part to change the pressure at the fixing nip, and the rotation transmitting part include:

a first rotating body provided on a rotation shaft of the fixing member; and a second rotating body engaged with the first rotating body and supported so as to be rotatable around the fulcrum part, the fulcrum part is used as a member supporting the fixing frame in addition to the second rotating body.

10. An image forming apparatus comprising:

an image forming part which transfers a toner image on a sheet; and a fixing device according to claim 9, which fixes the toner image on the sheet.

* * * * *